US007892060B2

(12) United States Patent
Huxley

(10) Patent No.: US 7,892,060 B2
(45) Date of Patent: Feb. 22, 2011

(54) QUARTZ GLASS LAMP AND METHOD FOR FORMING A QUARTZ GLASS LAMP

(75) Inventor: Lawrence Huxley, Cambridge (GB)

(73) Assignee: Heraeus Noblelight Ltd., Cambridge (GB)

( * ) Notice: Subject to any disclaimer, the term of this patent is extended or adjusted under 35 U.S.C. 154(b) by 874 days.

(21) Appl. No.: 11/111,568

(22) Filed: Apr. 21, 2005

(65) Prior Publication Data

US 2005/0258755 A1 Nov. 24, 2005

(30) Foreign Application Priority Data

May 19, 2004 (GB) ..... 0411170.4

(51) Int. Cl.
*H01J 9/00* (2006.01)

(52) U.S. Cl. ..... 445/26; 445/22; 445/23

(58) Field of Classification Search ..... 445/22, 445/23, 25, 26, 29
See application file for complete search history.

(56) References Cited

U.S. PATENT DOCUMENTS

| | | | | |
|---|---|---|---|---|
| 2,177,685 | A | 10/1939 | Bol et al. | |
| 2,316,999 | A | 4/1943 | Spencer | |
| 2,675,497 | A | 4/1954 | Meister et al. | |
| 3,868,528 | A | 2/1975 | Lake et al. | |
| 3,959,860 | A * | 6/1976 | Schindler | 445/28 |
| 4,326,324 | A * | 4/1982 | Stephens | 445/71 |
| 5,979,187 | A * | 11/1999 | Churchley et al. | 65/32.2 |
| 6,229,257 | B1 * | 5/2001 | Kondoh et al. | 313/493 |
| 6,812,642 | B1 * | 11/2004 | Niimi | 313/623 |
| 2004/0124776 | A1 * | 7/2004 | Iorio et al. | 313/625 |
| 2004/0174121 | A1 * | 9/2004 | Tsuda et al. | 313/635 |
| 2005/0127839 | A1 * | 6/2005 | Choi | 313/607 |

FOREIGN PATENT DOCUMENTS

| | | | |
|---|---|---|---|
| EP | 1 289 001 | A2 | 3/2003 |
| GB | 310066 | | 4/1929 |
| GB | 494447 | | 10/1938 |
| GB | 498617 | | 1/1939 |
| GB | 2 030 000 | A | 3/1980 |
| GB | 2 308 226 | A | 6/1997 |
| JP | 02-160358 | A | 6/1990 |
| JP | 11-250860 | A | 9/1999 |
| JP | 2003346726 | * | 12/2003 |

* cited by examiner

*Primary Examiner*—Bumsuk Won
(74) *Attorney, Agent, or Firm*—Panitch Schwarze Belisario & Nadel LLP

(57) ABSTRACT

A method is provided for formation of a glass to metal seal at one end of a quartz lamp tube, as part of the process of manufacturing a complete lamp tube. The method involves a direct sealing of the tube of quartz glass with a seal material surrounding an electrode or its electrical feed through. The seal material may be in the form of a bead having a generally elliptical or spherical shape.

8 Claims, 1 Drawing Sheet

QUARTZ GLASS LAMP AND METHOD FOR FORMING A QUARTZ GLASS LAMP

BACKGROUND OF THE INVENTION

This invention relates to mechanically strong and leak-free sealing of bodies comprising a tube of fused silica and a high temperature material of an electrical feed through, such as are used as flash lamps and laser lamps, and in particular to the construction of the ends of such lamps and a method of effecting the sealing of electrodes into the ends thereof.

According to UK published patent application GB 23 08 226 or U.S. Pat. No. 5,979,187, flash and laser lamps are generally constructed from a tube of fused silica/quartz, the opposite ends of which contain metal electrodes to which electrical operating power is supplied via conductive supports, which also serve to mount the lamp in a lamp holder, when in use.

Due to the different coefficients of expansion of metal and fused silica/quartz, special materials have been developed for interposing between the metal conductive supports for the electrodes and the tube wall of such lamps, to accommodate the differential rates of expansion, as the lamp in use increases and decreases in temperature. Typically, the electrodes are constructed from tungsten and an intermediate sleeve of a glass-like material having an appropriate coefficient of expansion, such as a sealing glass, is formed around the tungsten rod before it is introduced into and sealed to an end of the lamp tube. Sealing glass is supplied, inter alia, by Schott Glass Ltd., and GS10 sealing glass as supplied by Schott Glass has been used with quartz and tungsten combinations.

As used herein, the expression GS is intended to mean any suitable material which can be bonded to a metal electrode and likewise fused to fused silica/quartz materials and whose coefficient of expansion is such as to accommodate the generally greater expansion of metal (for a given temperature rise), than is produced in fused silica/quartz by the same rise in temperature. GSiO sealing glass is an example of a GS material.

The constructional steps of the known method leading to the formation of a glass to metal seal at an end or a fused silica/quartz tube are as follows:

(1) A tungsten electrode is prepared to receive a sleeve of GS sealing glass, by heating and rotation about its longitudinal axis;

(2) A stick of GS is also heated and, as the end of the stick becomes molten, it is brought into contact with the rotating heated tungsten rod support which extends axially from the tungsten electrode, so that molten glass becomes attached to and "smeared" over the surface of the rod to form a relatively uniform thickness sleeve over approximately 1-2 cm of the length of the rod;

(3) The central region of the sleeve is increased in thickness by reheating it and the GS stick, and while the sleeved rod is rotated, touching the end of the glass stick against the central region of the sleeve to cause an annular build-up of GS to occur. This step is commonly referred to as "spinning a bead" onto the sleeve;

(4) Next, a fused silica/quartz tube, cut to the desired length of the lamp housing, is heated at one end, while being rotated around its longitudinal axis, and the heated end is closed by spinning a bead of molten GS into and over the heated end of the tube. (The GS stick is of course heated before it is brought into contact with the heated end of the tube);

(5) One end of a smaller diameter tube of fused silica/quartz is then heated, the interior of the lamp tube is pressurised with a non-oxidizing gas, typically and usually nitrogen, and a region of the wall thereof is heated until soft to permit the heated end of the smaller diameter tube to be pushed therethrough and fused thereto, so as to extend radially as a side tube therefrom. By pushing the end of the smaller diameter side tube through the locally heated, softened region of the lamp tube wall, the interior of the latter communicates with the interior of the side tube, and this communication is maintained by maintaining a positive gas pressure in the lamp tube while the fusing is completed. After this the heat is removed;

(6) The end of the radially protruding side tube which has just been added is now closed by heating the outboard end thereof to collapse the side tube wall;

(7) The previously closed end of the fused silica/quartz lamp tube is now reheated, and the internal pressure of the assembly of tubes is increased, so as to cause the GS dome, which has closed the heated lamp tube end, to balloon axially and puncture;

(8) While rotating the lamp tube and keeping the punctured end hot and near molten, a carbon tool is introduced into the punctured end, and the diameter of the opening in the GS dome is made concentric with the lamp tube axis and enlarged, so as to be capable of receiving the electrode; and (9) The electrode and its integral sleeved rod is now introduced axially into the opened end of the lamp tube, while the latter is rotated until the annular bead makes contact with the end of the lamp tube. Both are reheated until the GS becomes molten and can be worked, using a carbon tool, so as to cause the ring of GS defining the open end of the lamp tube to become merged with the GS bead on the tungsten rod, and the GS material to become fused into a uniform annular seal.

A lamp requires a similar arrangement at the opposite end, and the appropriate steps may be repeated at the opposite end of the lamp tube to enable a second electrode to be sealed in a similar manner into the opposite end.

Final assembly of a lamp involves evacuation of the lamp tube assembly and usually the introduction of a specific gas, usually at low pressure, via the side tube, which is then finally closed off and sealed by heating.

BRIEF SUMMARY OF THE INVENTION

Lamps constructed in accordance with the above method have been found to possess a weakness in the end regions thereof, where a GS to GS seal has been formed. Investigations have indicated possible reasons for this weakness, and it is an object of the present invention to provide an improved method which reduces the chance of weakness being introduced into the structure by the manufacturing process.

The problem is a high deviation in seal quality. It is an object of the present invention to increase the reliability of the seal by reducing the deviation. This deviation should be reduced without a loss in quality of the seal.

According to one aspect of the present invention, an improved process for the formation of a glass to metal seal at one end of a quartz lamp tube, as part of the process of manufacturing a complete lamp tube, is characterized by a direct sealing of the tube of quartz glass with the seal material around an electrode or its electrical feed through.

Surprisingly, neither a dome need be sealed to the tube of quartz glass, nor is there a need for a three-part-body-tube of quartz glass with stronger ends.

Compared with the prior art, this method is very simple. Therefore, the process of the invention is extraordinarily quick manually and allows an automated sealing process, which moreover guarantees a further minimizing of quality tolerance.

The beads of the present invention could have a small deformation resulting from the adaptation to the tube of quartz glass. Therefore, the final shape of the bead could have a small notch and a slight asymmetry.

The present invention enables the production of lamps of high quality seal with a small quality tolerance. These lamps are characterized in that the tubes of quartz and the electrodes or their electrical feed through are directly sealed with sealing beads.

Preferably, the body is a laser lamp or a flash lamp. Although developed for quartz laser lamps, the seal is not restricted to that application. It is suitable for any application where a mechanically strong and leak-free seal needs to be made between quartz and a high temperature material of an electrical feed through, such as tungsten, in order to bring an electrical source or current into any form of lighting or discharge lamp, scientific apparatus or measuring instrument, or display devices of any kind, all of these incorporating the use of vacuum or gases for their operation.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
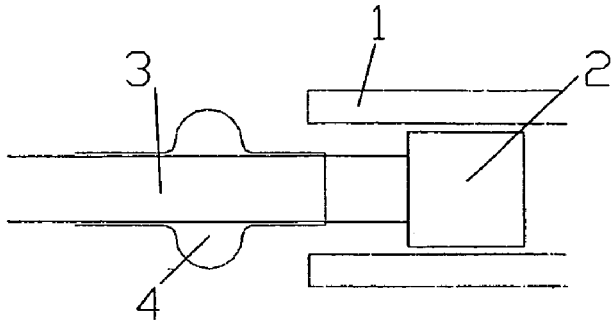
FIG. 1 is a schematic diagram illustrating a lamp tube on the right and an electrode with an elliptical bead on the left, before assembly.
Figure 2:
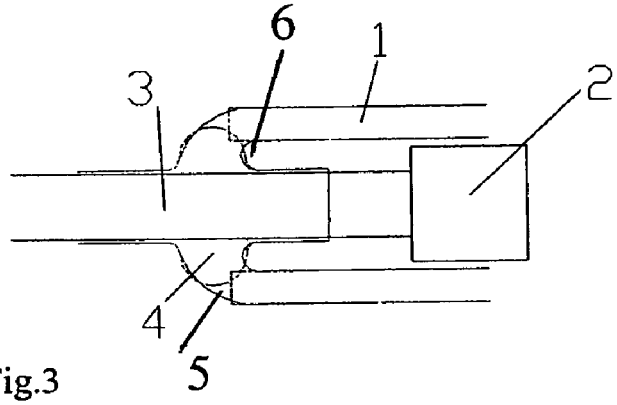
FIG. 2 is a schematic diagram illustrating the lamp tube and bead of FIG. 1 connected.
Figure 3:
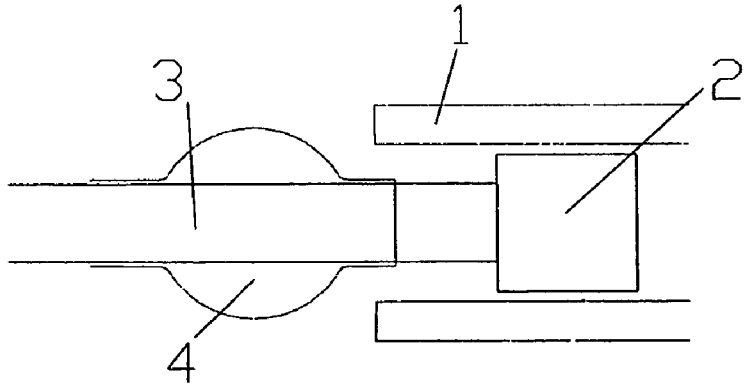
FIG. 3 is a schematic diagram similar to FIG. 1, illustrating a bead having a spherical shape.

A preferred embodiment of the method of present invention comprises the following steps:

(1) A tungsten pin 3 is coated with sealing glass comprising a sheath and bead, the bead 4 being larger than the internal diameter of the fused silica/quartz tube 1, but no larger than the external diameter of the fused silica/quartz tube 1 (FIG. 1). The fused silica/quartz tube 1 forms the lamp housing and typically has a 0.5 mm wall thickness;

(2) The bead 4 is heated to a soft state while rotating it on a lathe and is inserted into the annulus of the lamp housing tube 1 to form a seal 5;

(3) After the insertion, the seal 5 is then heated to allow the sealing glass to wet on and to fuse with the housing tube (FIG. 2); and (4) After fusing the bead 4 to the quartz tube 1, both internally and to the end of the quartz tube, and while the sealing glass is molten, an internal positive pressure is applied, causing the sealing glass inside the quartz tube to move back toward the previously open end of the tube to form a smooth internal radius (at 6 in FIG. 2). The step of applying pressure to move the sealing glass back toward the end of the quartz tube not only creates:

(4a) a smooth radius between the electrode or the electrical feed through and the quartz tube; and (4b) an area on the internal diameter that now has a coating of sealing glass transitioning to the fused bead, effectively creating an internal radius of sealing glass. This radius is critical to the seal.

Figure 4:
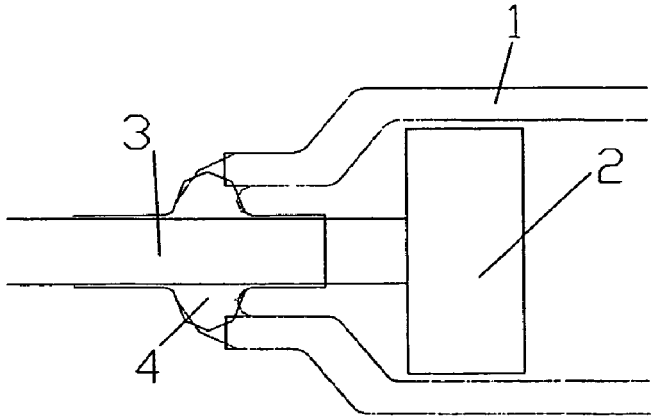
FIG. 4 is a schematic diagram similar to FIG. 2, illustrating a lamp tube which is crimped to a smaller diameter to form the seal.

In a further embodiment of the method of the invention, the end of the quartz glass tube is molten and may be softly pressed to a heated bead (FIG. 4). Pre-forming or tooling of the quartz tube is possible to create different starting conditions for this process.

The method of the invention is much simpler than the corresponding methods of the prior art. Now GS is only required as a bead on one side of the seal. This may be prepared elsewhere and does not necessarily need to be made in one step with the formation of the seal. In addition, no more tooling and/or pre-processing of the quartz tube is required.

No tooling is needed to form the seal, only heat and pressure, which significantly reduces the risk of seal contamination.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method of forming a quartz glass lamp containing electrodes within a tube of quartz glass, the method comprising:

(a) surrounding the electrodes or an electrical feed through of the electrodes with a bead of sealing glass;

(b) inserting the electrode or the electrical feed through of the electrode into an annulus of the quartz glass tube, thereby directly contacting the bead of sealing glass to the quartz glass tube;

(c) heating the quartz glass tube and bead of sealing glass to allow the bead of sealing glass to wet on and fuse with the quartz glass tube; and (d) applying, while the bead of sealing glass is molten, a positive pressure within the quartz glass tube to form a smooth internal radius of the bead of sealing glass between the electrode or the electrical feed through and the quartz glass tube.

2. The method of claim 1, wherein the sealing glass has a coefficient of expansion between that of the electrode or the electrical feed through and that of the quartz glass.

3. The method of claim 1, wherein prior to step (b), the bead of sealing glass is heated to a soft state and rotated on a lathe.

4. The method of claim 1, wherein the bead of sealing glass in step (a) is provided with a size larger than an internal diameter of the quartz glass tube but less than or equal to an external diameter of the quartz glass tube.

5. The method of claim 1, wherein prior to step (a), the annulus of the quartz glass tube is pre-formed to a predetermined dimension.

6. The method of claim 1, wherein the annulus of the quartz glass tube is molten during step (b).

7. The method of claim 1, wherein the quartz glass tube is provided for a laser or flash lamp.

8. The method according to claim 1, wherein the sealing step is carried out using automatic equipment.

* * * * *